United States Patent [19]

Chaix et al.

[11] 4,208,987

[45] Jun. 24, 1980

[54] STEAM GENERATOR

[75] Inventors: Jean-Edmond Chaix, Manosque; Maurice Fajeau, Pertuis, both of France

[73] Assignee: Commissariat a l'Energie Atomique, Paris, France

[21] Appl. No.: 914,717

[22] Filed: Jun. 12, 1978

[30] Foreign Application Priority Data

Jun. 15, 1977 [FR] France ..... 77 18322

[51] Int. Cl.[2] ..... F22B 1/06

[52] U.S. Cl. ..... 122/32; 122/34; 122/406 R; 122/407

[58] Field of Search ..... 122/32, 34, 406 R, 407

[56] References Cited

U.S. PATENT DOCUMENTS

| | | | |
|---|---|---|---|
| 3,683,866 | 8/1972 | Zmola | 122/34 |
| 3,898,961 | 8/1975 | Mayer et al. | 122/407 |
| 3,916,841 | 11/1975 | Schroder et al. | 122/32 |
| 3,938,473 | 2/1976 | Mayer et al. | 122/34 |

*Primary Examiner*—Edward G. Favors

*Attorney, Agent, or Firm*—Sughrue, Rothwell, Mion, Zinn & Macpeak

[57] ABSTRACT

The steam generator is provided with a vertical cylindrical enclosure having a bundle of U-shaped tubes therein connected to inlet and outlet collectors through a tube plate at the bottom. An inner casing surrounding the tubes defines an annular chamber which communicates with the tube chamber adjacent the tube plate. A heater is provided about the outlet portion of the tubes within the tube chamber. An ejector pump supplying a secondary fluid is located in the annular chamber adjacent the heater for pumping secondary fluid through the heater. A portion of the heated secondary fluid is recirculated through the pump and the remainder is directed into the tube chamber. Vapor phase separators are provided on top of the inner casing to allow the passage of the vapor phase through an outlet in the enclosure while returning the liquid phase to the annular chamber.

3 Claims, 2 Drawing Figures

STEAM GENERATOR

BACKGROUND OF THE INVENTION

The present invention relates to a steam generator comprising an enclosure with a vertical axis containing a bundle of U tubes the ends of which are connected, respectively, via a horizontal tube plate extending transversely in the enclosure, to an inlet collector and an outlet collector for a primary fluid circulating in these tubes, which are bathed on the outside by a secondary fluid taken into the enclosure in liquid form and extracted therefrom in vapour form, a heater in which the secondary fluid is brought to its boiling temperature, located near the tube plate in the region of the tubes, this tube plate being connected to the outlet collector, and an inner casing surrounding the bundle of tubes and surmounted, at its upper end above this bundle, by separating devices for separating the liquid phase carried by the vapour phase, whilst the separated liquid phase is passed into an annular chamber provided between the casing and the enclosure so that this liquid phase comes into contact with the tube plate, and the overall recirculation in the steam generator may be assisted by ejector pumps activated by the secondary fluid as it enters the enclosure.

Various designs are already known for a steam generator of this kind, using a preliminary heater located in the region of the "cold portion" of the bundle of tubes; this heater makes it possible to increase the pressure of the vapour leaving the generator. Steam generators have also been designed which use ejector pumps to produce forced circulation of the secondary fluid in the liquid phase, particularly in the heater, permitting a higher flow rate and consequently an increase in the temperature of the secondary fluid in liquid form, at the tube plate. In particular, generators of this kind have been envisaged more especially in nuclear installations comprising a reactor using pressurised water which constitutes the primary fluid, whilst the secondary fluid also consists of water which is converted into saturated vapour as it passes through the generator.

BRIEF SUMMARY OF THE INVENTION

The present invention relates to an improvement to the known solutions mentioned hereinbefore, permitting much more flexible use of the heater, which can operate even with a supply of cold water, thanks to the high level of internal recirculation achieved. This also eliminates the possibility of accidental cold thermal shocks to the tube plate, thus obviating the need for any protective system for the latter.

The present invention makes it possible to obtain such a level of recirculation without any additional water passing into the separating devices, thus enabling them to operate under identical conditions to those in a conventional steam generator.

For this purpose, the steam generator under consideration is characterised in that the lower part of the annular chamber adjacent to the heater is isolated, by means of partitions, from the remaining volume of this annular chamber, and that the inner casing comprises, at right angles to the upper end of the heater, at least one communicating passage to the lower part of the annular chamber for recycling the majority of the flow of secondary fluid in the liquid phase as it leaves this heater, and in that this heater also has another passage through which the remaining flow passes towards the separating devices, after travelling through the bundle of tubes.

Advantageously, the lower part of the annular chamber comprises, above the passage through which the flow of secondary fluid from the heater is admitted, at least one collecting dome for the steam carried over and at least one tube connected to the end of this dome for the purpose of eliminating this vapour and preventing the ejector pumps from being unprimed.

BRIEF DESCRIPTION OF THE DRAWINGS

Other features of a steam generator constructed according to the invention will become apparent from the following description of an exemplary embodiment, which is given as a guide and not in any restrictive capacity, with reference to the attached drawings, wherein.

DETAILED DESCRIPTION OF THE PREFERRED EMBODIMENTS

Figure 1:
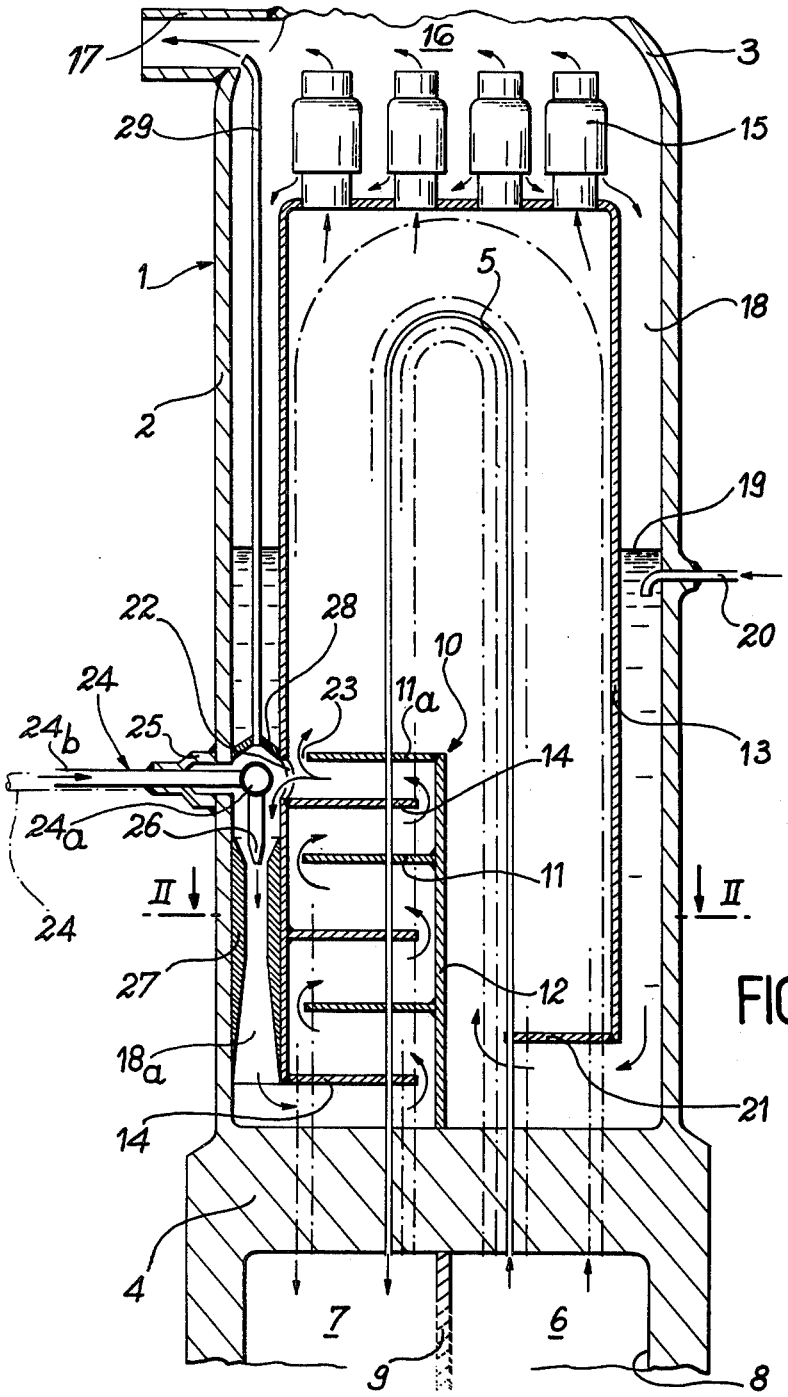
FIG. 1 is a diagrammatic view of a longitudinal section through the generator in question.

In the example shown in the figures, the steam generator as a whole is designated 1. It comprises in particular an outer enclosure 2 which is generally cylindrical in shape and has a vertical axis, closed off at its upper end by a substantially hemispherical base 3. At its lower end, the housing 2 is integral with a horizontal plate 4 or tube plate, to which are connected the ends of a bundle of U tubes 5, so that these tubes communicate with two chambers or collectors 6 and 7, respectively, which are defined in a cavity 8 provided below the plate 4 and separated from each other by a transverse partition 9. These collectors 6 and 7 constitute the inlet and outlet collectors of a pressurised primary fluid which is thus made to flow through the tubes of the bundle 5, and which may consist, in particular, of the cooling water of a pressurised nuclear reactor (not shown).

Inside the enclosure 2 there is provided, according to an arrangement which is known per se, a preliminary heater 10 comprising a series of transverse partitions 11 connected to a diametric plate 12 mounted in the housing 2 between the hot and cold portions, respectively, of the bundle of tubes 5, these plates 11 being penetrated by the tubes of the hot portion of this bundle. Through these tubes, the primary fluid returns through the tube plate 4 to the outlet collector 7. The bundle of tubes 5 is also surrounded by a cylindrical skirt 13 mounted inside the enclosure 2 and extending coaxially to the latter, this skirt having on the inside a series of semicircular plates 14 parallel to the plates 11 and arranged between the latter so as to define, inside the preliminary heater 10, a zigzag path for a secondary fluid, usually water, passing through the generator and intended to produce vapour on contact with the tubes 5 and by heat exchange with the primary fluid passing through these tubes. The upper part of the inner skirt 13 supports a series of separating devices 15, the constructional details of which are irrelevant to the invention, these devices 15 permitting the mixture of liquid and vapour of the secondary fluid, which is formed on contact with the bundle of tubes, to be finally separated into a saturated vapour phase collected in the region 16 below the upper base 3 before being evacuated through an outlet duct 17, whilst the remaining liquid phase is passed outside the casing 13 into an annular chamber 18 defined between this casing and the inner surface of the outer housing 2. In this annular chamber 18, the secondary water in liquid form accumulates up to the level which is diagrammatically shown at 19 in FIG. 1; this level can be adjusted by means of an additional intake tube 20 provided in the side wall of the housing 2.

At its lower end, in the region of the "hot portion" of the bundle of tubes 5, hence opposite the preliminary heater 10, the inner skirt 13 comprises a distributer plate 21 which channels the water coming from the chamber 18 as it passes into the bundle of tubes and permits correct sweeping of the bottoms of the tubes at the tube plate 4. The secondary water then rises into the bundle of tubes 5 where it is vaporised at least partially, to return to the separators 15 above the bundle, and so on.

Figure 2:
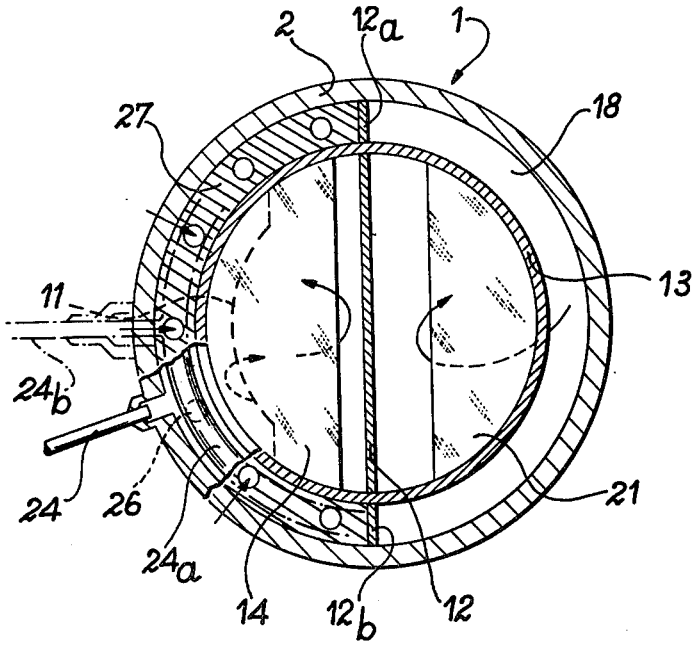
FIG. 2 is a detailed view of a cross section on the line II—II in FIG. 1.

According to the invention, the inner skirt 13 comprises, at right angles to the upper part of the preliminary heater 10, a large opening 22 which enables the secondary water, circulating essentially in liquid form inside this heater, to be recycled with regard to the majority of its flow, into the lower part **18*a* of the annular chamber, in order to pass back into the heater. This part 18*a* is isolated from the remaining volume of the annular chamber 18 by a system of partitions comprising a horizontal partition (not shown) at right angles to the upper part of the heater and two vertical partitions 12*a* and 12*b* (see FIG. 2) on an extension of the diametric plate 12. Moreover, the upper plate 11*a* of the heater 10 comprises an opening 23 such that the remaining flow of secondary water passing through the heater can rise into the bundle of tubes 5 and reach the separating devices 15**.

To ensure the permanent circulation of the secondary water in the heater and in the lower part **18*a* of the annular chamber 18, this water is supplied to this lower part 18*a* through a tube passing through a thermal sleeve 25. Furthermore, a second pipe 24*b* is connected to a distribution gradient 24*a* which serves a series of nozzles 26, each of which co-operates with a part having a hose-like inner profile 27; the whole forms an ejector pump of the conventional type. Thanks to these arrangements, the flow of the supply of secondary water ensures that the recycled water coming from the preliminary heater 10 via the passage 22 will be carried along to be returned under pressure to the base of the heater in order to pass through this heater again. Moreover, according to an advantageous feature of the invention, the lower part 18*a* comprises, above the ejector pumps described hereinbefore, a dome 28 which enables the vapour coming from the heater 10 and carried along with the liquid phase to be recycled, to be collected above the ejector pumps and then evacuated through a tube 29 opening into the region 16**.

The ejector pumps used to ensure the recirculation of the secondary water leaving the preliminary heater are designed so that, at full power, a considerable level of recirculation is obtained, enabling the bases of the tubes near the tube plate 4 to be swept continuously, whilst ensuring uniform temperatures in this plate and thus reducing thermal stresses. Of course, the advantage obtained depends on the temperature of the supply of secondary water, i.e. the power required to reheat it and the temperature difference permitted between the secondary water bathing the bases of the tubes on the hot side and the secondary water bathing the bases of the tubes on the cold side.

Thanks to the by-pass effect obtained with tubes 24 and **24*b***, it is also possible to regulate the temperature of the secondary water in the vicinity of the tube plate to the minimum value necessitated by the thermal stresses permitted on the tube plate, thus enabling the maximum pressure of the vapour leaving the generator to be obtained.

The invention is not limited to the embodiments described and represented hereinbefore and various modifications can be made thereto without passing beyond the scope of the invention.

What is claimed is:

1. A steam generator comprising a substantially cylindrical enclosure having a vertical axis, a horizontal tube plate disposed in the enclosure adjacent the lower end thereof, inlet and outlet collector chambers disposed in said enclosure below said tube plate, a bundle of U-shaped tubes disposed in said enclosure with the ends connected through said horizontal tube plate to said inlet collector and said outlet collector, respectively, for circulating a primary fluid through said tubes, means for providing a secondary fluid into the enclosure in liquid form and means for extracting said secondary fluid from the enclosure in vapor form, an inner casing surrounding said bundle of tubes, separating devices located at the upper end of said inner casing above said bundle of tubes for separating the liquid phase from the vapor phase and passing said liquid phase into an annular chamber provided between said casing and said enclosure so that the liquid phase comes into contact with said tube plate, a heater in which the secondary fluid is brought to its boiling temperature located in said casing adjacent said plate with said bundle of tubes passing therethrough, ejector pump means disposed in the lower part of said annular chamber adjacent said heater, partition means in the lower part of said annular chamber defining a pump chamber adjacent said heater separate from the remaining volume of said annular chamber, first passage means through said casing communicating the upper end of said heater with said pump chamber, second passage means through said casing communicating the lower part of said pump chamber to said heater for recycling the majority of the flow of secondary fluid in liquid form through said pump chamber back to said heater and an additional passage means from the top of said heater to said chamber defined by said casing above said heater through which the remaining flow passes towards the separating means after passing around the bundle of tubes above said heater.

2. A steam generator according to claim 1, wherein said pump chamber includes, above said first passage means through said casing, at least one collecting dome for vapor from said secondary fluid, at least one tube communicating with the top of said dome to remove this vapor and prevent the ejector pumps from being unprimed.

3. A steam generator according to claim 1, further comprising at least one intake pipe for secondary fluid connected to said pump chamber to provide a "by-pass" of the ejector pumps.

* * * * *